US008721281B2

(12) United States Patent
Krückels et al.

(10) Patent No.: US 8,721,281 B2
(45) Date of Patent: May 13, 2014

(54) COOLED BLADE FOR A GAS TURBINE

(75) Inventors: Jörg Krückels, Birmenstorf (CH); Thomas Heinz-Schwarzmaier, Wettingen (CH); Brian Kenneth Wardle, Brugg-Lauffohr (CH)

(73) Assignee: Alstom Technology Ltd., Baden (CH)

( * ) Notice: Subject to any disclaimer, the term of this patent is extended or adjusted under 35 U.S.C. 154(b) by 0 days.

(21) Appl. No.: 13/193,548

(22) Filed: Jul. 28, 2011

(65) Prior Publication Data

US 2012/0020787 A1 Jan. 26, 2012

Related U.S. Application Data

(63) Continuation of application No. PCT/EP2010/051112, filed on Jan. 29, 2010.

(30) Foreign Application Priority Data

Jan. 30, 2009 (CH) ..... 0142/09

(51) Int. Cl.
*F01D 5/18* (2006.01)

(52) U.S. Cl.
USPC ..... 416/1; 416/97 R

(58) Field of Classification Search
USPC ..... 415/115; 416/1, 97 R
See application file for complete search history.

(56) References Cited

U.S. PATENT DOCUMENTS

| | | | | |
|---|---|---|---|---|
| 4,303,374 | A * | 12/1981 | Braddy | 416/97 R |
| 5,288,207 | A | 2/1994 | Linask | |
| 6,481,966 | B2 | 11/2002 | Beeck et al. | |
| 6,599,092 | B1 * | 7/2003 | Manning et al. | 416/97 R |
| 6,602,047 | B1 | 8/2003 | Barreto et al. | |
| 7,121,787 | B2 * | 10/2006 | Jacks et al. | 415/115 |
| 2005/0232770 | A1 * | 10/2005 | Rawlinson et al. | 416/97 R |
| 2006/0222497 | A1 * | 10/2006 | Lee | 416/97 R |

FOREIGN PATENT DOCUMENTS

| | | | |
|---|---|---|---|
| EP | 1113145 | A1 | 7/2001 |
| EP | 1707741 | A2 | 10/2006 |
| EP | 1715139 | A2 | 10/2006 |

* cited by examiner

*Primary Examiner* — Edward Look
*Assistant Examiner* — Jason Davis
(74) *Attorney, Agent, or Firm* — Buchanan Ingersoll Rooney PC

(57) ABSTRACT

A cooled blade for a gas turbine includes a blade airfoil extending between leading and trailing edges in a flow direction and on suction and pressure sides is delimited by a wall, which include an interior space in which cooling air flows towards the trailing edge in the flow direction and discharges to the outside in the region of the trailing edge. The pressure-side wall terminates at a distance in front of the trailing edge in the flow direction, forming a pressure-side lip, such that the cooling air discharges from the interior space on the pressure side. Multiple ribs subdivides the interior space, parallel to the flow direction, into a plurality of parallel cooling passages which create a high pressure drop and in which turbulators are arranged for increasing cooling. Before the outlet, multiple flow barriers are provided in the cooling air flow path, distributed transversely to the flow direction.

9 Claims, 1 Drawing Sheet

COOLED BLADE FOR A GAS TURBINE

CROSS REFERENCE TO RELATED APPLICATIONS

This application is a continuation of International Application No. PCT/EP2010/051112 filed Jan. 29, 2010, which claims priority to Swiss Patent Application No. 00142/09, filed Jan. 30, 2009, the entire contents of all of which are incorporated by reference as if fully set forth.

FIELD OF INVENTION

The present invention relates to the field of gas turbines. Specifically, it refers to a cooled blade for a gas turbine. The invention furthermore refers to a method for operating such a blade.

BACKGROUND

A stator blade of the first row of a gas turbine is known from printed publication EP-A1-1 113 145, which shows a typical cooling arrangement for the trailing edge of the blade. A combination of ribs and pins in the cooling air flow which is guided towards the trailing edge ensures effective cooling, wherein the cooling air mass flow is controlled by means of a restricting device on the trailing edge. This type of cooling, however, has the disadvantage that comparatively thick trailing edges are required, as a result of which significant aerodynamic losses ensue.

For the necessary optimization of efficiency and output power it is necessary:

that the trailing edge of the blade is constructed as thin as possible in order to minimize the aerodynamic losses there, and that as little cooling air as possible is consumed.

A lower consumption of cooling air can be achieved by advanced cooling technology and by the use of recooled cooling air. The trailing edges can be designed thinner if the cooling air is released on the pressure side of the blade. Furthermore, the reduced cooling air flow requires restricting at the trailing edge which develops a high blocking action. A large blocking action, however, leads to a widthwise-uneven distribution of the cooling air film which is formed at the trailing edge, resulting in local overheating ("hot spots").

SUMMARY

The disclosure is directed to a cooled blade for a gas turbine. The blade includes a blade airfoil which extends between a leading edge and a trailing edge in a flow direction and on a suction side and on a pressure side is delimited by a wall. The walls include an interior space in which cooling air flows towards the trailing edge in the flow direction and discharges to the outside in the region of the trailing edge, the pressure-side wall terminating at a distance in front of the trailing edge in the flow direction forming a pressure-side lip, in such a way that the cooling air discharges from the interior space on the pressure side. The interior space, at a distance in front of the trailing edge, is sub-divided by a plurality of ribs, which are oriented parallel to the flow direction, into a plurality of parallel cooling passages which create a pressure drop. Turbulators are additionally arranged for increasing the cooling effect, and just before an outlet of the cooling air from the interior space a plurality of flow barriers are arranged in the flow path of the cooling air and distributed transversely to the flow direction.

In another aspect, the disclosure is directed to a method for operating a cooled blade in a gas turbine. The blade includes a blade airfoil and a blade root. The blade airfoil extends between a leading edge and a trailing edge in a flow direction and on a suction side and on a pressure side is delimited in each case by a wall. The walls include an interior space with cooling passages. In the interior space a cooling air flow flows towards the trailing edge of the blade airfoil and discharges to the outside in a region of the trailing edge. The method includes providing axial ribs, for enlarging a heat transfer surface between walls and cooling air flow, which act in the interior space. The method also includes providing rib-like turbulators in the cooling passages, which increase the heat transfer coefficient in the associated sphere of influence, the axial ribs and the turbulators bring about a pressure drop. Further, the method includes providing flow barriers, at an outlet of the trailing edge, which create a homogeneity of the cooling air flow in a associated sphere of influence with a minimized blocking action.

BRIEF DESCRIPTION OF THE DRAWINGS

The invention shall subsequently be explained in more detail based on exemplary embodiments in conjunction with the drawing. All elements which are not necessary for the direct understanding of the invention have been omitted. Like elements are provided with the same designations in the various figures. In the drawings.

DETAILED DESCRIPTION OF THE PREFERRED EMBODIMENTS

Introduction to the Embodiments

Figures 1, 2:
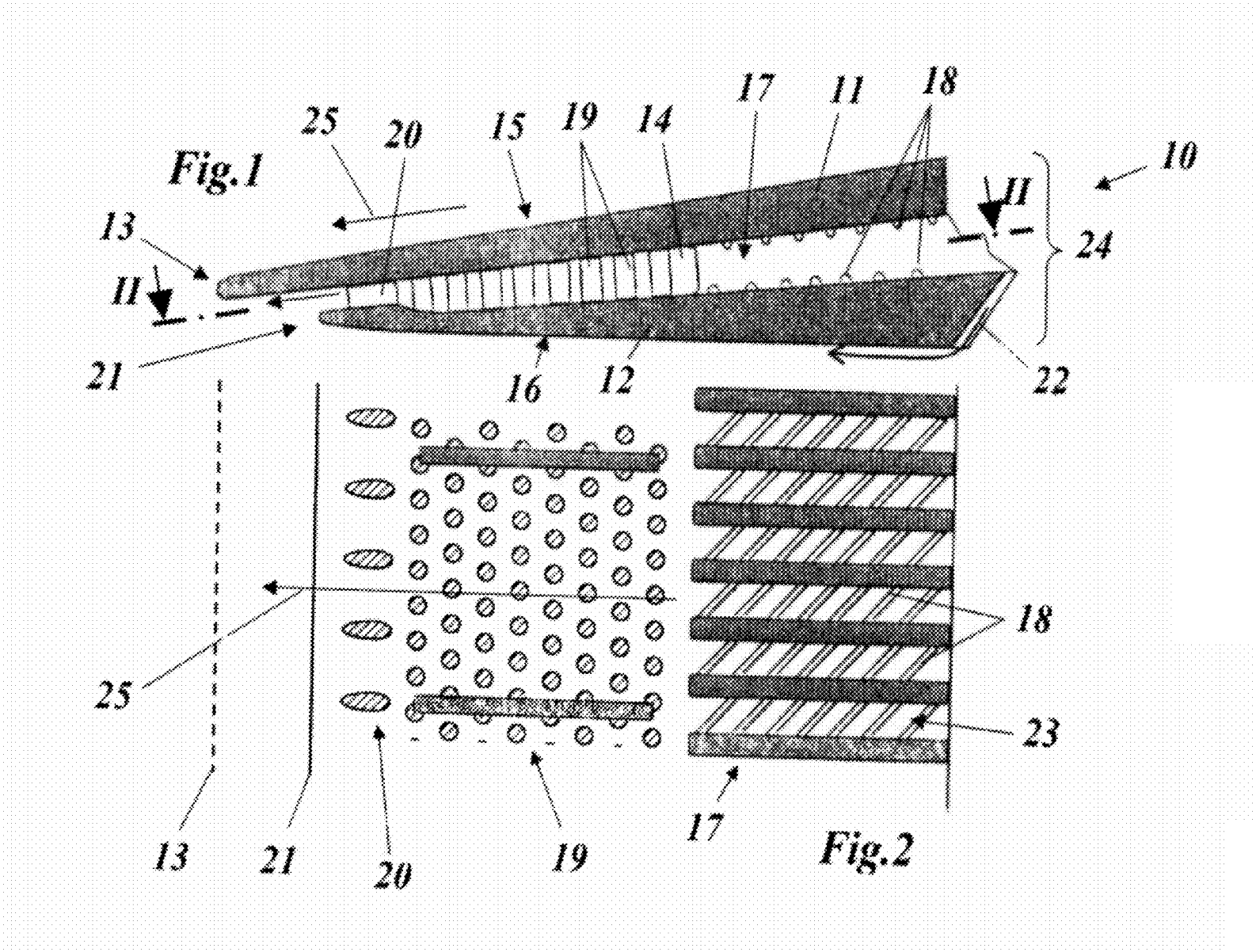
FIG. 1 shows the detail of a cross section through a blade according to an exemplary embodiment of the invention.
FIG. 2 shows the section in the plane II-II of FIG. 1.

It is therefore an object of the invention to create a cooled blade for a gas turbine of the type referred to in the introduction which avoids the disadvantages of the previous blades and at the same time provides low aerodynamic losses and a significantly reduced consumption of cooling air.

The object is achieved by means of the entirety of the features of claim 1. It is preferable for the solution according to the invention that the pressure-side wall terminates at a distance in front of the trailing edge in the flow direction, forming a pressure-side lip, in such a way that the cooling air discharges from the interior space on the pressure side, that the interior space, at a distance in front of the trailing edge, is sub-divided by a large number of ribs, which are oriented parallel to the flow direction, into a large number of parallel cooling passages which create a large pressure drop, and in which turbulators are additionally arranged for increasing the cooling effect, and that provision is made just before the outlet of the cooling air from the interior space in the flow path of the cooling air for a multiplicity of flow barriers which are distributed transversely to the flow direction.

In one development of the invention, the linear density of the flow barriers is lower than the linear density of the ribs.

According to another development of the invention, the flow barriers have in each case a teardrop-shaped edge contour, wherein the pointed end points in the flow direction.

In a further development of the invention, a large number of pins are arranged in a two-dimensional grid arrangement between the cooling passages and the flow barriers and extend transversely to the flow direction through the interior space between the suction-side and pressure-side walls.

Obliquely disposed ribs on the inner sides of the suction-side and pressure-side walls can especially be used as turbulators in the cooling passages.

The cooled blade is also operated so that axial ribs act in the interior space of such a blade and create an enlargement of the surface for a heat transfer between walls and cooling air flow. Furthermore, advantages ensue if provision is made in the cooling passages for rib-like turbulators which increase the heat transfer coefficient in the associated sphere of influence. Advantages also then ensue if the axial ribs and the turbulators are installed at the same time, which then bring about a pressure drop so that as a result provision can specifically be made at the outlet of the trailing edge for flow barriers which create a homogeneity of the cooling air flow in the associated sphere of influence with a minimized blocking action. Furthermore, these flow barriers, as a result of a teardrop-shaped design, can minimize the lateral uneven distribution of the cooling air film which ensues there so that large trailing vortices cannot arise at all behind these flow barriers.

DETAILED DESCRIPTION

FIGS. 1 and 2 show the internal construction of the blade airfoil 24 of a blade 10 for a gas turbine according to an exemplary embodiment of the invention. The blade 10 has a (convex) suction side 15 and a (concave) pressure side 16, of which only the sections lying in the proximity of the trailing edge 13 are shown in FIG. 1. On the suction side 15, the blade airfoil 24 is delimited by a first wall 11, and on the pressure side 16 is delimited by a second wall 12. The two walls 11, 12 enclose an interior space 14 which is exposed to throughflow by cooling air for cooling the blade airfoil 24. The hot gas of the turbine flows past the blade airfoil 24 in a flow direction 25 which points from the leading edge (not shown in FIG. 1) to the trailing edge 13. The cooling air flows in the same direction through the interior space 14 and discharges from the blade 10 in the region of the trailing edge 13.

In the case of the blade of FIG. 1, the trailing edge 13 is formed by the end of the suction-side wall 11. The pressure-side wall 12 terminates at a distance in front of this trailing edge 13 so that the cooling air already discharges in the ensuing gap on the pressure side 16 in front of the trailing edge 13 and brings about a film cooling of the trailing edge 13. As a result of the offset arrangement of the edges of the two walls 11 and 12, a particularly thin, cooled trailing edge 13 ensues, which significantly reduces the aerodynamic losses at the trailing edge 13.

The cooling air which is fed inside the blade 10, on its way to the trailing edge 13, is first directed through a large number of parallel cooling passages 23 which are oriented in the flow direction 25 and formed by means of axial ribs 17 between the two walls 11 and 12. In the cooling passages 23, turbulators 18 in the form of oblique ribs are arranged on the inner sides of the walls 11, 12, as a result of which the exchange of heat with the walls 11, 12 is increased. Pins 19, which are arranged in a distributed manner in a grid structure style, follow the flow passages 23 and, like the axial ribs 17, extend between the two walls 11, 12 and improve the cooling of the wall in this region. Finally, the cooling air passes an individual row of teardrop-shaped flow barriers 20 and then discharges from the blade 10 on the pressure side 16 between pressure-side lip 21 and trailing edge 13. In this case, the cross-sectional shape of these flow barriers 20 is not limited exclusively to a teardrop shape. The flow barriers 20 can have a flow-conforming or virtually flow-conforming cross section. Other flow shapes can be used from case to case. If the flow is to be influenced in a specific direction or intensity, then the flow barriers 20 are correspondingly designed. The linear density of the flow barriers 20 is lower in this case than the linear density of the axial ribs 17. This, however, is again not be understood as being compulsory because, depending upon the type of design, the density of the flow barriers 20 can be selected the same as or higher than the linear density of the axial ribs 17.

On the pressure side 16, upstream of the cooling passages 23, provision is additionally made for a row of film cooling holes 22, through which cooling air discharges on the pressure side 16 and forms a cooling film there.

The blade includes the following characteristics and provides the following advantages:

The axial ribs 17 enable a cooling arrangement for a relatively broad aerodynamic profile. The cooling passages 23 between the axial ribs 17 have a sufficiently small cross-sectional area in order to achieve high flow velocities even for large spaces between suction side and pressure side.

The axial ribs 17 enlarge the surface for a transfer of heat between walls and cooling air flow.

The rib-like turbulators 18 in the cooling passages 23 additionally increase the heat transfer coefficient.

The axial ribs 17, together with the turbulators 18, bring about a large pressure drop. This enables flow barriers 20 with a comparatively low blocking action to be used as a restricting device at the outlet, which leads to a very even cooling air film at the trailing edge 13.

The pin arrays 19 are used in a region where the space between suction side and pressure side is already smaller.

Teardrop-shaped flow barriers 20 are used in order to minimize the lateral uneven distribution of the cooling air film by large trailing vortices being avoided behind the barriers.

A row of film cooling holes 22 on the pressure side 16 enables a lowering of the temperature in the rear section of the pressure side 16.

LIST OF DESIGNATIONS

10 Blade (gas turbine)
11 Wall (suction side)
12 Wall (pressure side)
13 railing edge
14 Interior space
15 Suction side
16 Pressure side
17 Axial rib
18 Turbulator
19 Pin
20 Flow barrier
21 Pressure-side lip
22 Film cooling hole
23 Cooling passage
24 Blade airfoil
25 Flow direction

What is claimed is:

1. A cooled blade, for a gas turbine, comprising:

a blade airfoil which extends between a leading edge and a trailing edge in a flow direction and on a suction side and on a pressure side is delimited by a wall, wherein the walls include an interior space in which cooling air flows towards the trailing edge in the flow direction and discharges to an outside area in the region of the trailing edge, the pressure-side wall terminating at a distance in front of the trailing edge in the flow direction, forming a pressure-side lip, in such a way that the cooling air discharges from the interior space on the pressure side, the interior space, at a distance in front of the trailing edge, is sub-divided by a plurality of ribs, which are oriented parallel to the flow direction, into a plurality of parallel cooling passages which create a pressure drop and in which turbulators are additionally arranged for increasing the cooling effect, and before an outlet of the cooling air from the interior space a plurality of flow barriers are arranged in the flow path of the cooling air and distributed transversely to the flow direction, wherein each flow barrier extends in the flow direction to a point upstream of the pressure-side lip.

2. The cooled blade as claimed in claim 1, wherein the flow barriers have a flow-conforming or virtually flow-conforming cross section.

3. The cooled blade as claimed in claim 1, wherein the flow barriers have a teardrop-shaped edge contour, a pointed end thereof pointing in the flow direction.

4. The cooled blade as claimed in claim 1, wherein a plurality of pins are arranged in a two-dimensional grid arrangement between the cooling passages and the flow barriers and extend transversely to the flow direction through the interior space between the suction-side and pressure-side walls.

5. The cooled blade as claimed in claim 1, wherein obliquely disposed ribs on the inner sides of the suction-side and pressure-side walls are provided as turbulators in the cooling passages.

6. The cooled blade as claimed in claim 1, wherein the pressure-side lip forms a straight linear edge along an entire length.

7. A method for operating a cooled blade in a gas turbine, said blade comprising a blade airfoil and a blade root, the blade airfoil extends between a leading edge and a trailing edge in a flow direction and on a suction side and on a pressure side is delimited in each case by a wall, the pressure-side wall terminating at a point upstream of the trailing edge in the flow direction to form a pressure-side lip, wherein the walls include an interior space with cooling passages, in said interior space a cooling air flow flows towards the trailing edge of the blade airfoil and discharges to an outside area in a region of the trailing edge, the method comprising:

providing axial ribs, for enlarging a heat transfer surface between walls and cooling air flow, which act in the interior space;

providing rib-like turbulators in the cooling passages, which increase the heat transfer coefficient in the associated sphere of influence, the axial ribs and the turbulators bring about a pressure drop; and providing flow barriers, at an outlet of the trailing edge, having a lower or higher linear density than the linear density of the axial ribs, which create a homogeneity of the cooling air flow in an associated sphere of influence with a minimized blocking action, wherein each flow barrier extends in the flow direction to a point upstream of the pressure-side lip.

8. The method as claimed in claim 7, wherein the flow barriers having a teardrop-shaped form, minimize lateral uneven distribution of the cooling air film which ensues, thereby avoiding large trailing vortices behind the flow barriers.

9. The method as claimed in claim 7, wherein the pressure-side lip forms a straight linear edge along an entire length.

* * * * *